US007051913B2

(12) United States Patent
Chuang

(10) Patent No.: US 7,051,913 B2
(45) Date of Patent: May 30, 2006

(54) SAFETY CONTROL CIRCUIT FOR DIRECT CURRENT ELECTROMOTIVE NAIL DRIVER

(76) Inventor: Chao-Yi Chuang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/847,595

(22) Filed: May 18, 2004

(65) Prior Publication Data

US 2005/0258211 A1 Nov. 24, 2005

(51) Int. Cl.
*B25C 1/04* (2006.01)

(52) U.S. Cl. ..... 227/2; 227/8; 227/131; 361/153; 361/155

(58) Field of Classification Search ..... 227/2, 227/8, 131, 156; 361/152, 153, 155, 156
See application file for complete search history.

(56) References Cited

U.S. PATENT DOCUMENTS 3,141,171 A * 7/1964 Doyle et al. ..... 227/2
3,589,587 A * 6/1971 Manganaro ..... 227/131
4,349,143 A * 9/1982 Ewig ..... 227/131
4,449,161 A * 5/1984 Kling ..... 361/152
4,500,938 A * 2/1985 Dulin ..... 361/153
4,558,391 A * 12/1985 Ward et al. ..... 361/155
4,573,624 A * 3/1986 Muller et al. ..... 227/121
4,618,087 A * 10/1986 Lai ..... 227/131
5,666,715 A * 9/1997 Zoiss et al. ..... 29/566.4
6,431,425 B1 * 8/2002 Moorman et al. ..... 227/8
6,766,935 B1 * 7/2004 Pedicini et al. ..... 227/131
6,796,475 B1 * 9/2004 Adams ..... 227/2
6,880,740 B1 * 4/2005 Lu ..... 227/131

* cited by examiner

*Primary Examiner*—Scott A. Smith

(57) ABSTRACT

A safety control circuit for a direct current electromotive nail driver comprises: a direct current power source for supplying power to the circuit; a control and protecting unit having a security switch, a trigger switch and a stop switch; and a motor for driving an object. When the security switch is turned on and then the trigger switch is pressed, the control and protecting unit will receive a signal from the trigger switch so as to conduct the motor and thus the motor operates to drive an object. When the motor operates through a predetermined time period, the stop switch will actuate a protection function of the control and protecting unit so that the motor cannot operate until the security switch is actuated again.

2 Claims, 2 Drawing Sheets

SAFETY CONTROL CIRCUIT FOR DIRECT CURRENT ELECTROMOTIVE NAIL DRIVER

FIELD OF THE INVENTION

The present invention relates to nail drivers and particular to a safety control circuit for a direct current electromotive nail driver which can provide a preferred protection to the nail driver.

BACKGROUND OF THE INVENTION

Electric nail drivers are more and more popular to the workers since they can make the people drive nails easily. In the prior art, the electric nail drivers have security switches for preventing the carelessness of people. When a trigger switch is pressed, the nail is beaten. If the security switch does not close, the trigger switch is actuated again, a nail will be beaten. Then, it is possible that an accident occurs. Thereby, the prior art security switch cannot protect a preferred protection.

SUMMARY OF THE INVENTION

Accordingly, the primary object of the present invention is to provide a safety control circuit for a direct current electromotive nail driver which can provide a preferred protection to the nail driver.

To achieve above objects, the present invention provides a safety control circuit for a direct current electromotive nail driver comprises: a direct current power source for supplying power to the circuit; a control and protecting unit having a security switch, a trigger switch and a stop switch; and a motor for driving an object. When the security switch is turned on and then the trigger switch is pressed, the control and protecting unit will receive a signal from the trigger switch so as to conduct the motor and thus the motor operates to drive an object. When the motor operates through a predetermined time period, the stop switch will actuates to actuate a protection function of the control and protecting unit so that the motor cannot operate until the security switch SW1 is actuated again.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
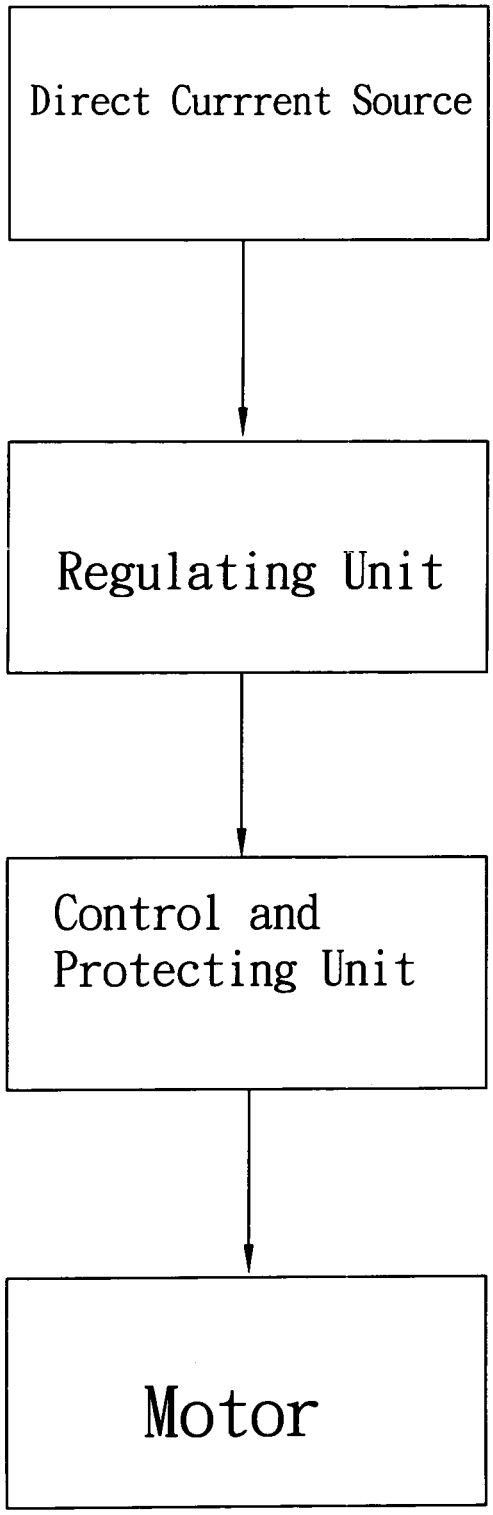
FIG. 1 shows a block diagram about the safety control circuit for a direct current electromotive nail driver of the present invention.

With reference to FIG. 1, the operation block diagram of the present invention is illustrated. In the present invention, a control circuit structure is disclosed. The control circuit has a motor and is actuated by a direct current source. The control circuit includes a regulating unit, a control and protecting unit, and a motor. The regulating unit serves to provide a steady current to the control and protect unit. The control and protecting unit is installed with a security switch, a trigger switch and a stop switch. When the security switch is actuated, the trigger switch is actuated. The motor is conducted. After a small time period, the stop switch is actuated so as to actuate the protection function of the control and protecting unit. When the security switch is not closed and the trigger switch is triggered carelessly, the motor cannot operate. The control and protect unit stops until the user closes the security switch. Thereby, if it is desired to trigger again, the security switch must be turned off and then actuate. Then the trigger switch is pressed and the motor operates again.

Figure 2:
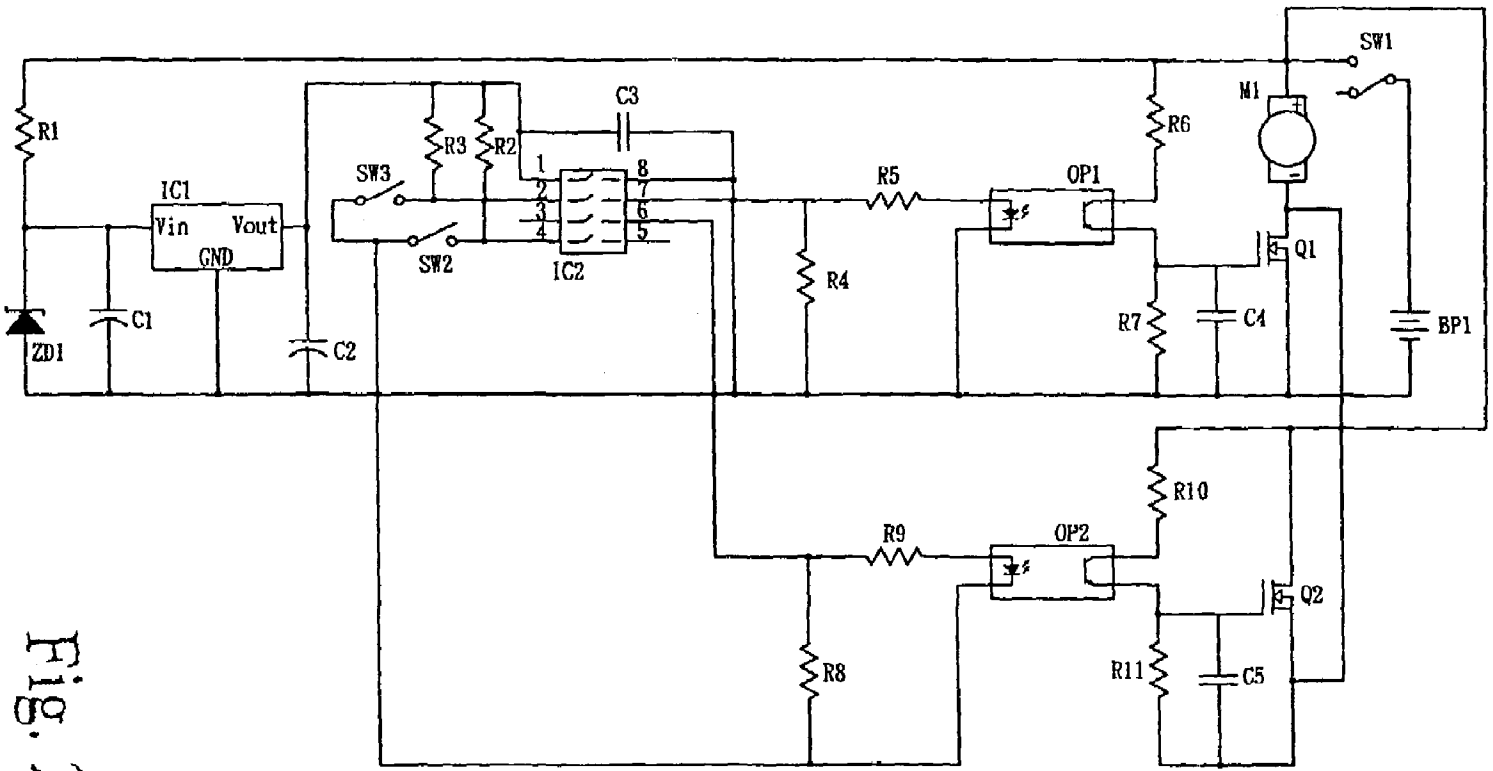
FIG. 2 is a circuit diagram of the safety control circuit for a direct current electromotive nail driver of the present invention.

With reference to FIG. 2, the regulating unit includes a Zener diode ZD1 and a regulating IC (IC1) (IC: integrating circuit) and capacitors C1 and C2.

The control and protecting unit is formed by a security switch SW1, a trigger switch SW2 and a stop switch SW3, a single chip controller IC2, two optical coupling ICs (OP1, OP2), and two metal-oxide-semiconductor field effect transistors (MOSFET Q1 and MOSFET Q2).

A direct current power sotirce BP1 serves for supplying power to the circuit.

When the security switch SW1 is turned on, current from the direct current power source BP1 flows through the Zener diode ZD1 so as to confine the voltage to be within 12 Volts. Then the current flows through the regulating IC (IC1 so as to output a steady voltage to the single chip controller IC2. The regulating IC, and the capacitors C1 and C2 serves as a power source lower frequency filter.

When the user presses the trigger switch SW2 through 0.1 second, a seventh pin of single chip controller IC2 is retained in a high level output so as to actuate the optical coupling IC (OP1) so that the voltage is transferred to the gate of the N channel MOSFET Q1 to conduct the source and drain of the MOSFET Q1. Thereby, the MOSFET Q1 and the direct current power source BP1 are formed as a circuit loop.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A safety control circuit for a direct current electromotive nail driver comprising:

a direct current power source for supplying power to the circuit;

a control and protecting unit having a security switch, a trigger switch and a stop switch; and a motor for driving an impact rod to compress an elastomer;

wherein when the security switch is turned on and then the trigger switch is pressed, the control and protecting unit will receive a signal from the trigger switch so as to conduct the motor; when the motor operates through a predetermined time period, the stop switch will actuates to induce a protection function of the control and protecting unit so that the motor can not operate until the security switch is actuated again;

wherein the control and protecting unit has a single chip controller for actuating and de-actuating the trigger switch and the stop switch, wherein control and protecting unit has two optical coupling and two metal-oxide-semiconductor field effect transistors for actuating and de-actuating the motor.

2. A safety control circuit for a direct current electromotive nail driver comprising:

a regulating unit including a Zener diode and a regulating IC and a first capacitor and a second capacitor; wherein the first and second capacitors and the Zener diode being parallel connected to the regulating IC;

a control and protecting unit formed by a security switch SW1, a trigger switch SW2 and a stop switch SW3, a single chip controller IC2, two optical coupling Ics (OP1, OP2); and two metal-oxide-semiconductor field effect transistors (MOSFET Q1, MOSFET Q2);

a direct current power source for supplying power to the circuit; and a motor for driving an object;

wherein when the security switch is turned on, current from the direct current power source flows through the Zener diode so as to confine the voltage to be within a predetermined voltage; then the current flowing through the regulating IC so as to output a steady voltage to the single chip controller IC; the regulating IC, and the two capacitors serve as a power source lower frequency filter.

* * * * *